United States Patent [19]

Kawakami

[11] 3,955,523

[45] May 11, 1976

[54] METHOD OF CONTINUOUSLY BUILDING SHIPS

[75] Inventor: Takaaki Kawakami, Hisai, Japan

[73] Assignee: Nippon Kokan Kabushiki Kaisha, Tokyo, Japan

[22] Filed: Mar. 4, 1975

[21] Appl. No.: 555,224

[30] Foreign Application Priority Data

Mar. 20, 1974 Japan ..... 49-30989

[52] U.S. Cl. ..... 114/65 R; 61/64; 114/77 R

[51] Int. Cl.[2] ..... B63B 9/06

[58] Field of Search ..... 114/77 R, 77 A, 65 R; 61/64

[56] References Cited

UNITED STATES PATENTS 3,011,252 12/1961 Svensson ..... 114/65 R 3,489,118 1/1970 Sugizaki et al. ..... 114/77 R

*Primary Examiner*—Trygve M. Blix
*Assistant Examiner*—Stuart M. Goldstein
*Attorney, Agent, or Firm*—Ladas, Parry, Von Gehr, Goldsmith & Deschamps

[57] ABSTRACT

A method of building ships wherein a middle building area whose ends may be bounded by means of a pair of detachable partition gates is provided inside an open-ends type dock, whereby after a stern body of each ship has been constructed in the middle building area the stern body is moved into one of the building areas which are defined on both sides of the middle building area and in which the entire length of the ships can be constructed, and a middle body and a stem body are constructed extending from said stern body in the building area to build a completed ship.

3 Claims, 18 Drawing Figures

METHOD OF CONTINUOUSLY BUILDING SHIPS

BACKGROUND OF THE INVENTION

The present invention relates to a method of continuously building ships in an open-ends type building dock.

In known methods of continuously building a plurality of ships of an open-ends type dock having a length of at least two and half times the length of ships to be built as for example disclosed in Japanese Laid-open Patent Publication No. 44794/1972, a pair of partition gates are arranged in the middle portion of the dock to provide the partitions for two ships, whereby a stern body is constructed in the remaining dock space, a stem body is constructed extending from the stern without moving the latter, then in consideration of the undocking time of a completed ship the thus constructed ship is moved to the basin side where the necessary fitting out of the ship is carried out and thereafter the ship is undocked as the completed ship.

A disadvantage of the above type of methods is that while this type of methods ensures the most effective use of an open-ends type dock with a resultant considerably improved building efficiency, the ships must be moved in their half-built condition with the result that it is difficult to fixedly arrange the necessary welding equipment, scaffoldings, etc., and moreoever the movement of the ships requires much time and labor since the ships are very heavy objects.

SUMMARY OF THE INVENTION

With a view to overcoming the foregoing difficulties, it is an object of the present invention to provide an improved method of building ships.

It is another object of the present invention to provide an improved method of continuously building ships in an open-ends type dock wherein the open-ends type dock is provided in the middle portion thereof with places for arranging at least two detachable gates, whereby when the construction of a stern is completed in the dock space between the gates, the stern is moved toward the stem side within the dock, and a middle body and a stem body are constructed extending from said stern to build a completed ship which is in turn undocked as such.

DESCRIPTION OF THE PREFERRED EMBODIMENTS

The present invention will now be described in greater detail with reference to the illustrated embodiments of the invention.

Figure 1:
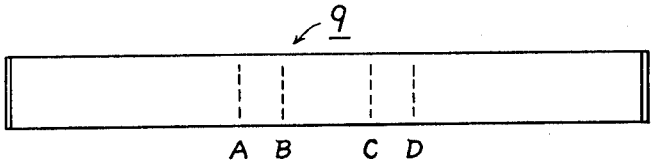
FIG. 1 is a plan view of a dock for explaining one example of performing the novel method of the present invention.
Figure 2:
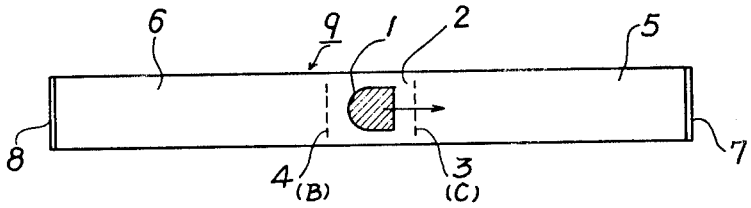
FIGS. 2, 3, 4, 5, 6 and 7 are plan views of the dock for explaining a series of operations for building ships according to the one example of performing the method of the invention.

Referring first to FIG. 1, there is illustrated one embodiment of an open-ends type dock 9 for performing the method of the invention. In FIG. 1, four dotted lines A, B, C and D indicate positions where partition gates may be detachably installed. In the embodiment shown in FIGS. 2 to 7, a middle building area 2 that will be described later is defined by the partition gate positions B and C, in the embodiment shown in FIGS. 8 through 13 the middle building area 2 is defined by the parition gate positions B and D, and in the embodiment shown in FIGS. 14 through 18 the middle building area 2 is defined by the partition gate positions A and D.

Figure 3:
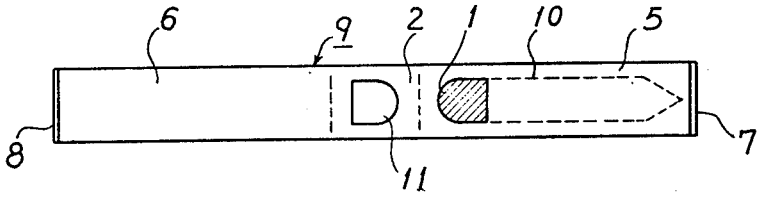
Figure 4:
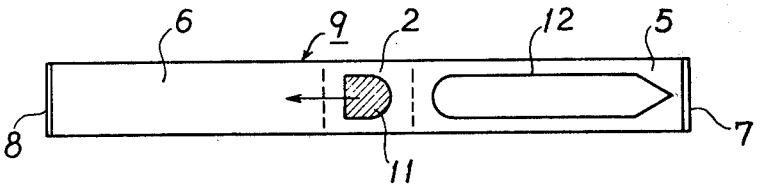

Referring to FIGS. 2 through 7, the open-ends type dock 9 is designed so that the middle building area 2 of a length sufficient for constructing a stern 1 is partitioned off at a first partition gate position 3 (that is C in FIG. 1) and a second partition gate position 4 (that is B in FIG. 1), a first building area 5 and a second building area 6 each having a length sufficient for building the entire length of a ship are respectively defined on the outside of the partition gate positions 3 and 4, and a third partition gate 7 and a fourth partition gate 8 are respectively provided on the sea side of the building areas 5 and 6 to cut off the communication between the respective building areas and the open sea, and the construction of the stern 1 (which may include part of the parallel middle body) is carried out in the middle cuilding area 2. For purposes of discussion, let it be assumed that in FIG. 2, the construction of the stern 1 is commenced with the stem side of the stern 1 being directed toward the first building area 5 and there is no ship under construction in the first and second building areas 5 and 6. Upon completion of the construction work of the stern 1, the stern 1 is moved into the first building area 5 by carrying means such as a carriage or traveler so that the construction of a middle and stem body 10 extending from the stern started, and at the same time the construction of a second ship stern 11 is commenced in the middle building area 2 with its stem side directed toward the second building area 6 as shown in FIG. 3.

Figure 5:
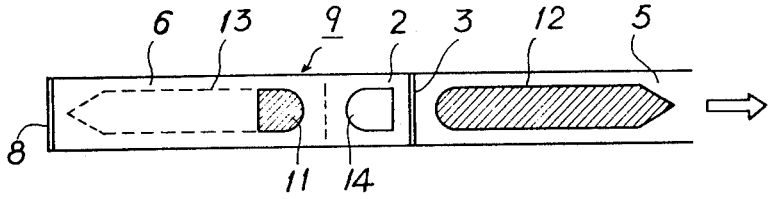
Figure 6:
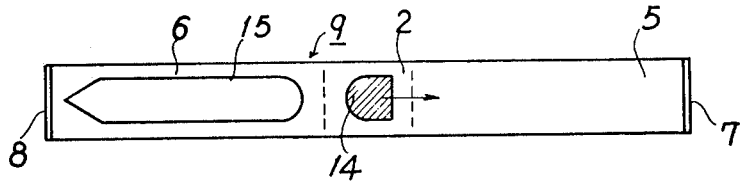
Figure 7:
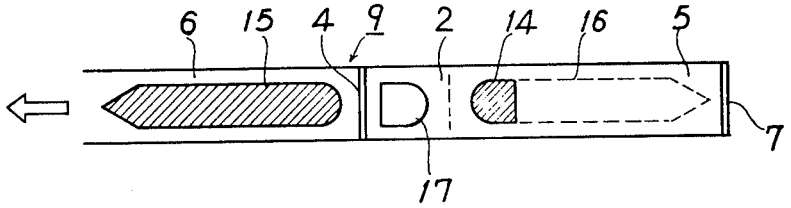

As the construction of a first ship 12 consisting of the stern 1 and the middle and stem body 10 progresses and the construction of the second ship stern 11 is completed in due course of time, the stern 11 is moved into the second building area 6 by the similar means as mentioned earlier as shown in FIG. 4 so that the construction of a middle and stem body 13 extending from the stern 11 is started and at the same time the construction of a third ship stern 14 is started in the second building area 2 with its stem side directed toward the first building area 5 as shown in FIG. 5. After the first ship 12 has been completed, the middle building area 2 and the first buildng area 5 are isolated from each other at the first partition gate position C by the gate 3 and the first building area 5 is filled with water. When this occurs, the third gate 7 is opened and the first ship 12 is towed out into the open sea. Thereafter, as shown in FIG. 6, while continuing the construction work of a second ship 15 consisting of the second ship stern 11 and the middle and stem body 13, the third ship stern 14 is moved into the first building area 5 upon completion thereof. Then, as shown in FIG. 7, a middle and stem body 16 is constructed extending from the stern 14 and the construction work of a fourth ship stern 17 is started in the middle building area 2 with its stem side being directed opposite that of the stern 14 while completing the second ship 15 in the second building area 6. In this way, the continuous building of ships is accomplished without any interruption.

Figure 8:
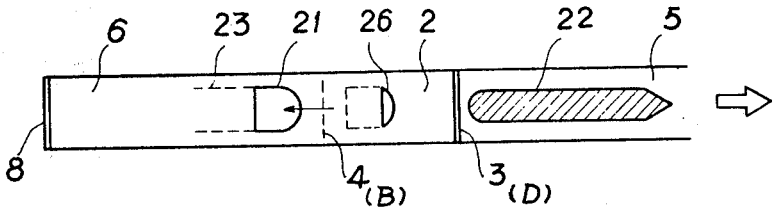
FIGS. 8, 9, 10, 11, 12 and 13 are plan views of the dock for explaining a series of operations according to another example of performing the method of the invention.
Figure 9:
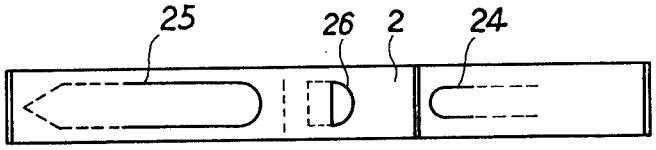
Figure 10:
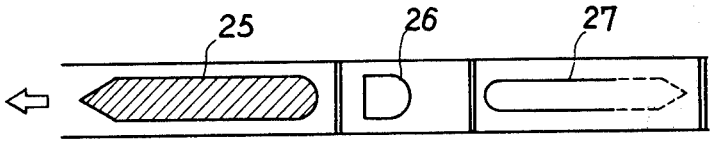
Figure 11:
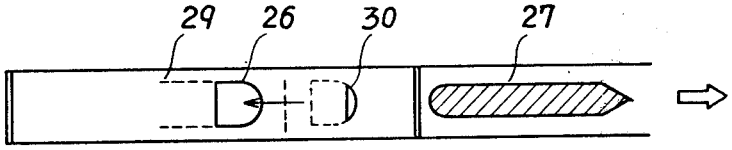
Figure 12:
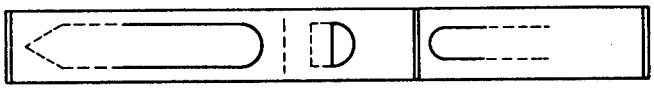
Figure 13:
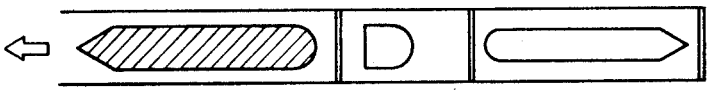

FIGS. 8 through 13 show another example of performing the method of the invention in which ships of different sizes are continuously built. The partition gate positions B and D differ from those of the previously described arrangement B and C and therefore the dimension of the middle building area 2 is also different. In FIG. 8 showing one stage of the continuously progressing process of the shipbuilding work, a first small ship 22 has been completed and ready for undocking from the first building area 5, a stern 26 of a second large ship is under construction in the middle building area 2, and a middle and stem body 23 is being constructed extending from a stern 21 of a first large ship in the second building area 6. In the conditions shown in FIG. 9, the construction of a second small ship 27 is just started in the first building area 5 with the construction work being started on a stern 24, a stern 26 of the second large ship 29 is under construction in the middle building area 2 and the first large ship 25 is gradually progressing toward completion in the second building area 6. FIG. 10 shows the conditions in which the second small ship is well under way toward its completion, the scheduled portion of the second large ship stern 26 has been completed in the middle building area 2 and the first large ship 25 has been completed and ready for undocking. FIG. 11 shows the conditions in which the second small ship 27 has been completed, the second large ship stern 26 which previously was under construction in the middle building area 2 has been moved into the second building area 6 and a middle and stem body 29 is being constructed extending from the stern 26, and the construction of a stern 30 of a third large ship is about to take place in the middle building area 2. The conditions in the second building area 6 and the middle building area 2 shown in FIG. 11 are equivalent to those of FIG. 8, and it will thus be seen that the construction work is carried out with the operations shown in FIGS. 8, 9 and 10 constituting one working cycle. By installing the partition gate 3 at D and thus always isolating the first building area 5 for building small ships from the rest of the dock, it is possible to build small ships independently of the construction work of large ships.

Figure 14:
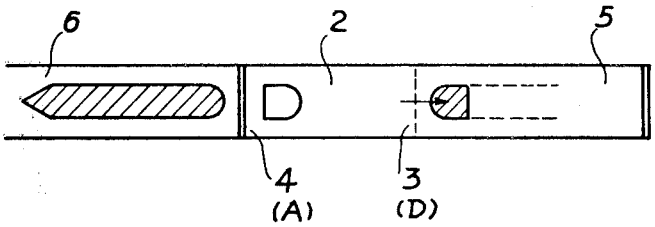
FIGS. 14, 15, 16, 17 and 18 are plan views of the dock for explaining still another example of performing the method of the invention.
Figure 15:
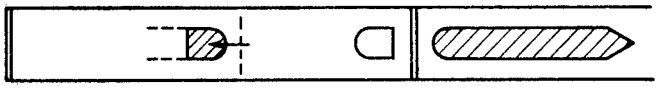
Figure 16:
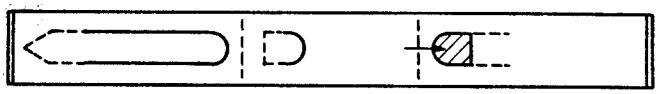
Figure 17:
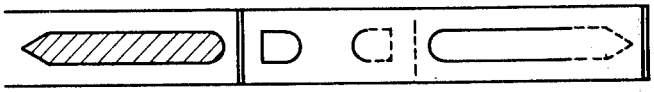
Figure 18:
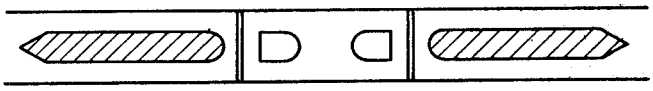

FIGS. 14 through 18 show another example performing the method of the invention which is particularly adapted for the building of small ships. The partition gate positions A and D are different from those of the previously described two examples, and the middle building area is also wider. FIG. 14 shows that a middle and stem body is being constructed and joined in the first building area 5 on to the stern which has been completed in the middle building area 2 and moved into the first building area 5. The construction of a stern for the next ship to be built in the first building area 5 will be started in the middle buidling area 2. FIG. 15 shows that the said first ship has been completed and ready for undocking, and this process is repeated to continuously built ships. The construction work of ships in the second building area 6 can take place independently of the construction work in the first building area 5, or alternately two ships can be built in accordance with the same series of operations.

It should be apparent that by suitably changing the position of partition gates in an open-ends type dock, it is possible to build a variety of combinations of ships such as a combination of large ships, a combination of a large ship and a small ship and a combination of small ships, and it is also possible to easily and smoothly change from one combination to another.

It will thus be seen from the foregoing description that in accordance with the first embodiment of the present invention, an open-ends type dock of a length approximately two and half times the entire length of a ship is used in such a manner that the stern which has been completed in the middle building area is moved within the dock into the first or second building area, and therefore there is no need to move a ship which has been almost completed, thus eliminating the danger of causing defects in the ship from the strength point of view due to the movement of the ship and reducing the cost of moving the ship. Further, by virtue of the fact that the middle building area will never be filled with water and the construction of sterns take place only in the middle building area, it is possible to arrange the building blocks, scaffoldings and so on as installations, and also there is no need to move the driving power source, the electric power source, etc. for the scaffolding installation, welding equipments, compressed air, etc. Moreoever, since the blocks, etc. can also be arranged as the installations in the first or second building area, the cost of moving such installations during the building of ships can be saved, and at the same time the construction work is conducted both in the middle building area and the first or second building area thus partially paralleling the construction of one ship with that of the next ship to thereby improve the utilization of the dock and in this way to contribute to the reduction of the building cost of ships.

In building ultra-superships, while the conventional method of mooring such superships at the fitting out basin gives rise to mooring difficulties due to the effect of wind forces, etc. caused by the greatly increased size of the ships, in accordance with the present invention, where the building of for example six ships per year is scheduled, the sterns for the six ships may be constructed in the middle building area to permit the undocking of the three ships from each of the building areas on both sides of the middle building area, so that the fitting out of the ships which have heretofore been carried out on the fitting out basin can be accomplished in the dock and therefore the ships can be undocked as the completely equipped ships. While this has the effect of reducing someowhat the utilization of the dock in relation to the ships built, this loss can be greatly outweighted by the gain in that not only the direct cost of mooring ships for outfitting works can be saved but also the redocking of the ships for completion delivery can be eliminated thus preventing a large sum of expenses. When these advantages are coupled with those advantages resulting from the subject matter of the present invention, the subject matter of the invention has a greater value and hence an enhanced industrial utility value.

What is claimed is:

1. A method of building ships, employing an open-ends type dock equipped with first and second removable partition gates to close off the ends of the dock, and third and fourth partition gates which can be installed at positions intermediate the ends of the dock so as to define a first building area between the first partition gate and the installment position of the third partition gate, a second building area between the second partition gate and the installment position of the fourth partition gate, and a middle building area between the installment positions of the third and fourth partition gates, the method comprising the following steps:- a. constructing the stern portion of a first ship in said middle building area;

b. moving the first ship's constructed stern portion into the first building area, the first partition gate being in its installment position;

c. continuing the construction of the first ship in the first building area by constructing a middle body and a stem body extending from the first ship's stern portion;

d. constructing the stern portion of a second ship in the middle building area;

e. moving the second ship's constructed stern portion into the second building area, the second partition gate being in its installment position;

f. continuing the construction of the second ship in the second building area by constructing a middle body and a stem body extending from the second ship's stern portion;

g. constructing the stern portion of a third ship in the middle building area;

h. installing the third partition gate in its installment position to isolate the middle building area from the first building area, removing the first partition gate from its installment position, floating the first ship out of the first building area, installing the first partition gate in its installment position, draining water from the first building area, removing the third partition gate from its installment position, and moving the third ship's constructed stern portion into the first building area, step (h) being commenced during step (d), (e), (f) or (g);

i. constructing the stern portion of a fourth ship in the middle building area;

j. installing the fourth partition gate in its installment position to isolate the middle building area from the second building area, removing the second partition gate from its installment position, floating the second ship out of the second building area, installing the second partition gate in its installment position, draining water from the second building area, removing the fourth partition gate from its installment position, and moving the fourth ship's constructed stern portion into the second building area, step (j) being commenced during step (g), (h) or (i), and so on, whereby the middle building area can be kept always essentially free of water by virtue of its being always isolated from the two ends of the dock when said ends are open.

2. A method of building ships, employing an open-ends type dock equipped with first and second removable partition gates to close off the ends of the dock, and third and fourth partition gates which can be installed at positions intermediate the ends of the docks so as to define a first building area between the first partition gate and the installment position of the third partition gate, and a second building area between the second partition gate and the installment position of the fourth partition gate, and a middle building area between the installment positions of the third and fourth partition gates, the method comprising the following steps:- a. constructing the stern portion of a first large ship in said middle building area;

b. moving the first large ship's constructed stern portion into the first building area, the first partition gate being in its installment position;

c. continuing the construction of the first large ship in the first building area by constructing a middle body and a stem body extending from the first large ship's stern portion;

d. commencing during step (c), constructing the stern portion of a second large ship in the middle building area;

e. installing the third partition gate in its installment position to isolate the middle building area from the first building area, removing the first partition gate from its installment position, floating the first large ship out of the first building area, installing the first partition gate in its installment position, draining water from the first building area, removing the third partition gate from its installment position, and moving the second large ship's constructed stern portion into the first building area;

f. starting with the second partition gate in its installment position, constructing a first smaller ship in the second building area, removing the second partition gate from its installment position when the second building area is isolated from the middle building area by the fourth partition gate floating the first smaller ship out of the second building area, installing the second partition gate in its installment position, draining water from the second building area, and commencing construction of a second smaller ship in the second building area, step (f) being performed during steps (a) to (e)

and so on, whereby large and smaller ships can be built continuously and the middle building area can be kept always essentially free of water by virtue of its being always isolated from the two ends of the dock when said ends are open.

3. A method of building ships, employing an open-ends type dock equipped with first and second removable partition gates to close off the ends of the dock, and third and fourth partition gates which can be installed at positions intermediate the ends of the dock so as to define a first building area between the first partition gate and the installment position of the third partition gate, a second building area between the second partition gate and the installment position of the fourth partition gate, and a middle building area between the installment positions of the third and fourth partition gates, the method comprising the following steps:- a. constructing the stern portion of a first ship in said middle building area;

b. moving the first ship's constructed stern portion into the first building area, the first partition gate being in its installment position;

c. continuing the construction of the first ship in the first building area by constructing a middle body and a stem body extending from the first ship's stern portion, while constructing the stern portion of a third ship in said middle building area;

d. installing the third partition gate in its installment position to isolate the middle building area from the first building area, removing the first partition gate from its installment position, floating the first ship out of the first building area, installing the first partition gate in its installment position, draining water from the first building area, removing the third partition gate from its installment position, and moving the third ship's constructed stern portion into the first building area;

e. constructing the stern portion of a second ship in said middle building area, moving the second ship's constructed stern portion into the second building area, the first partition gate being in its installment position, continuing the construction of the second ship in the second building area by constructing a middle body and a stem body extending from the second ship's stern portion while constructing the stern portion of a fourth ship in the middle building area, installing the fourth partition gate in its installment position to isolate the middle building area from the second building area, removing the second partition gate from its installment position, floating the second ship out of the second building area, installing the second partition gate in its installment position, draining water from the second building area, removing the fourth partition gate from its installment position, and moving the fourth ship's constructed stern portion into the second building area, step (e) being commenced during step (a), (b), (c) or (d), and so on whereby two ships can be built concurrently and the middle building area can be kept always essentially free of water by virtue of its being always isolated from the two ends of the dock when said ends are open.

* * * * *